United States Patent [19]

Osterhout et al.

[11] 3,971,117

[45] July 27, 1976

[54] METHOD OF REPAIRING INGOT MOLD BOTTOMS

[75] Inventors: Richard E. Osterhout; Walter A. McCray, both of Berea, Ohio; Mark J. Rudowicz, Griffith, Ind.

[73] Assignee: Hilti Aktiengesellschaft, Liechtenstein

[22] Filed: July 23, 1975

[21] Appl. No.: 598,221

[52] U.S. Cl. ..... 29/401 E; 29/401 D; 29/530; 249/174; 164/111; 228/119; 228/241; 249/204

[51] Int. Cl.[2] ..... B23P 7/00; B22D 41/00; B22D 41/08

[58] Field of Search..... 29/401 R, 401 A, 401 D, 29/401 E, 402, 530, 527.1, 527.5, 527.6; 249/174, 204; 164/111; 228/119, 241

[56] References Cited

UNITED STATES PATENTS

| | | | |
|---|---|---|---|
| 789,828 | 5/1905 | West et al. | 249/174 |
| 2,487,165 | 11/1949 | Miller | 29/530 |
| 2,563,559 | 8/1951 | Sneva | 29/530 |
| 2,722,734 | 11/1955 | Grant | 29/401 E |
| 2,876,535 | 3/1959 | Ray | 164/111 |
| 3,421,570 | 1/1969 | Guntermann | 228/241 |
| 3,682,435 | 8/1972 | Lofberg et al. | 249/174 |
| 3,918,624 | 11/1975 | Kurihara | 249/204 |

FOREIGN PATENTS OR APPLICATIONS

| | | | |
|---|---|---|---|
| 258,532 | 4/1970 | U.S.S.R. | 249/174 |

*Primary Examiner*—Victor A. DiPalma
*Assistant Examiner*—Dan C. Crane
*Attorney, Agent, or Firm*—Toren, McGeady and Stanger

[57] ABSTRACT

A method for repairing eroded bottoms of ingot molds by forming a casting space in the bottom of the mold at the point of erosion, the casting space having an hour-glass type shape, placing the ingot mold on a molding platform so as to close off the bottom of the casting space with a refractory material, placing a protective layer of a compactable refractory material about the interior of the mold and introducing to the casting space an alumino-thermic material and then igniting said alumino-thermic material such that the weld metal from the reaction thereof completely fills the casting space. Methods for repairing the bottoms of closed bottom as well as plug bottom molds are disclosed.

10 Claims, 11 Drawing Figures

METHOD OF REPAIRING INGOT MOLD BOTTOMS

BACKGROUND OF THE INVENTION

1. Field of the Invention

This invention relates to methods for repairing eroded bottoms of ingot molds. More particularly, this invention relates to a method for forming welded inserts in the bottom of eroded portions of ingot molds.

2. Description of the Prior Art

Various types of molds for preparation of steel ingots are conventionally used in steel mills. For example, various types of big end up molds, such as, open bottom, closed bottom, and plug bottom, are known. In the closed bottom and plug bottom molds, the bottoms thereof are subject to severe deterioration from the impact of the molten steel as it is poured into the mold. Thus, while such solid bottom molds have proved themselves to be essential in the production of certain types of steel, these type of ingot molds are expensive to produce as well as expensive to use in that their overall life expectancy is low.

A major reason for this is that many times, the center of the bottom of the closed bottom and plugged bottom mold is eroded away by the stream of molten steel as the ingot is poured. Such erosion of the bottom is troublesome as well as costly.

Thus, frequently, even though the bottom has not broken out, i.e., the erosion has not gone completely through the bottom of the mold, the indentation due to the erosion will cause the ingot to stick in the mold rendering normal ingot stripping procedures difficult or useless. In such a case, it is sometimes necessary to destroy molds in order to remove the ingot therefrom.

Additionally, as the mold is reused, the eroded portion increases in size and produces a protrusion on the bottom of the ingot which often represents unusable steel after removal of the ingot. The amount of such unusable steel in this protrusion, over the life of the ingot mold, can amount to an entire ingot of steel or more.

Efforts at repairing such molds have generaly been unsuccessful since the bottom of the repaired mold must possess essentially the same strength as the bottom of a new mold. Consequently, relatively expensive welding procedures have been used to repair such molds and, from an economic point of view, have not proved to be successful. Consequently, the life of the molds are substantially shortened since unsatisfactory economics discourage the regular repair of such molds by conventional expensive welding procedures.

SUMMARY OF THE INVENTION

Applicants have discovered a novel method for repairing closed bottom and plugged bottom ingot molds which have been damaged by erosion as discussed above. This method is particularly useful inasmuch as it can be carried out on the premises of a steel mill and can be used to repair molds which would otherwise have to be disposed of and, in fact, can result in doubling the life of the mold at relatively small cost.

More particularly, the present method comprises the steps of first removing the eroded portion of the bottom of the mold and forming a casting space therein by cutting a hole through the bottom. The cross-sectional area of the hole varies such that the diameter of the hole at the inner and outer surfaces of the bottom of the mold are larger than the cross-sectional area of the hole at the interior portion. Thus, the size of the hole, beginning from the inner surface of the mold bottom tapers inwardly towards a point in the interior portion of the mold bottom and then outwardly towards the outer or bottom surface of the mold bottom.

One or more notches are cut in the downward and outwardly tapering side of the hole to provide additional locking for the weld to be subsequently placed in the hole.

After the casting space has been cut, the mold is placed in an upright position on a smooth layer of a compactable refractory material and a protected layer of such refractory material is placed about the inner walls of the mold so as to form a funnel shaped chamber, the sides of which taper downwardly and inwardly towards the actual casting space.

The casting space and the lower portion of this funnel chamber are filled with an alumino-thermic welding material in an amount effective to provide sufficient weld metal to fill the casting space. Thereafter, the alumino-thermic mixture is ignited and reacts to form molten which flows downwardly through gravitation into the casting space to form, on cooling, an insert which completely fills the casting space and thus forms a new bottom portion or insert for the mold.

In the case of a plug bottom mold, the same procedure is followed with respect to forming of the casting space. However, after placement of the ingot on the smooth layer of refractory material, a tapered graphite plug is secured in the middle of the hole. The taper of the plug corresponds to the taper of the plug hole in the blue print of the ingot mold. The presence of this graphite plug thus creates an annular casting space, the outer edge of which is bordered by the sides of the hole and the inner edge of which is bordered by the tapering sides of the graphite plug.

After forming the funnel chamber from the refractory material and reacting the alumino-thermic material to form the welded portion and subsequent cooling, the graphite plug may be removed thereby providing an ingot mold having an appropriately sized and shaped hole in the bottom for use as a plug bottom mold.

DESCRIPTION OF THE PREFERRED EMBODIMENT

As noted hereinabove, the presently claimed invention can be used to repair both closed bottom and plug bottom ingot molds. The initial discussion will refer to the repair of a closed bottom ingot mold. It will be apparent that many of the points discussed therein, particularly with respect to mold selection and preparation of the interior of the mold as well as other steps in the process will pertain to the method for repairing plug bottom molds which is discussed at a later point herein.

Figure 1:
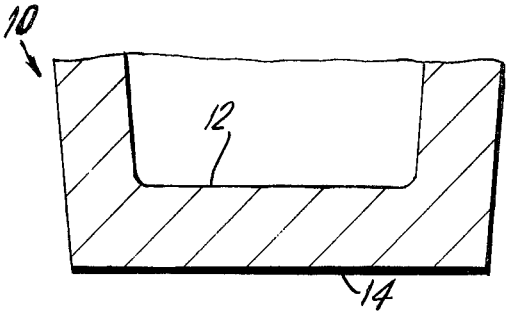
FIG. 1 is a partial cross-section view of the bottom of a closed bottom ingot mold.
Figure 2:
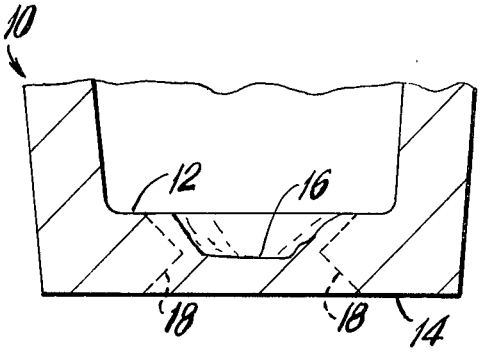
FIG. 2 is a view similar to that of FIG. 1 showing a closed bottom ingot mold having an eroded bottom.

Referring now to the drawings, and particularly, FIGS. 1 and 2, a partial cross-sectional view of the bottom of a big-end-up, closed bottom mold 10 is shown. For purposes of this discussion, the interior surface of the mold bottom will be designated as 12 and the outer surface of the mold bottom will be designated as 14.

FIG. 2 depicts a similar view of a mold wherein the inner surface of the mold bottom 12 has been eroded and possesses a rough depression 16 therein. As noted hereinabove, such erosion is caused by the pouring of the molten steel into the mold and generally occurs in the central portion of the mold bottom.

It is this type of destructive erosion which is the primary cause of shortened mold life in a steel mill and it is this type of defect which it is the intent of the present invention to rectify.

However, before selecting a mold for treatment by the present process, the mold should be thoroughly checked for other types of thermal and/or mechanical cracking along the outer side walls or any other defects which are not susceptible to repair by the present process. Thus, if there are other defects in the mold, such as, for example, horizontal cracks in the wall sides, or erosion of the interior sides of the walls, such a mold is essentially beyond repair by the present technique. Also, if the mold has been badly poured consistently and the eroded area has reached the side wall or slightly into it, then it is extremely difficult or impossible to satisfactorily repair the mold since the mold side wall eroded area would make it difficult to remove future ingots from the mold after pouring.

Figure 3:
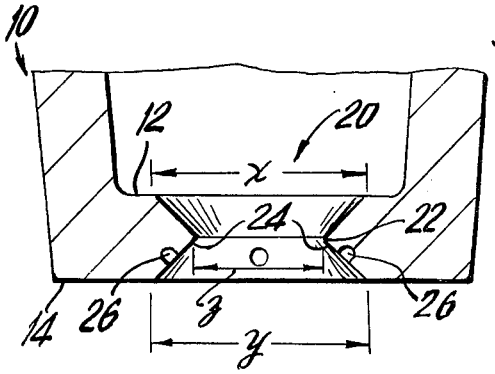

Presuming that the mold does not possess any defects other than the eroded portion in the center of the mold bottom, the eroded area 16 must be cleaned and burned away so as to create a hole through the bottom of the mold. The type of hole produced, hereinafter also referred to as a casting space, is shown in FIG. 3. Such a casting space is created by burning and grinding the area to be repaired, for example, using an AC4 iron powder cutting torch or an oxygen burning lance. Using this type of technique, the eroded portion of the mold bottom can be removed and a casting space having relatively smooth surfaces created.

The dotted lines in FIG. 2 designated as 18 depict the area to be cut away. While generally casting space 20 would have a circular cross-sectional area, it is possible to vary the nature of the cross-sectional area, for example, by making a square or elliptical shape. It is, however, important that the cross-section as shown by the view in FIG. 3 of the casting space have the general shape as shown since this ultimately serves to securely lock the inserted portion of the bottom into the mold bottom itself.

Referring now particularly to FIG. 3 and the nature of the casting space, it is seen that the cross-sectional areas $x$ and $y$, respectively, of that portion of the casting space at the inner surface 12 of the mold and the outer bottom surface 14 are larger than the cross-sectional area $z$ of the interior of the casting space 20. The cross-sectional area $z$ is generally considered to be at approximately the mid-point of the thickness of the mold bottom although it can be somewhat above or below the mid-point in actual practice. As shown, the side walls 20 beginning from the inner surface 12 of the mold slope downwardly and inwardly to the mid-point of the interior of the casting space designated as 22 and then slope downwardly and outwardly to the outer surface 14 of the bottom of the mold. This creates a casting space which in the cross-sectional view has the general shape of an hourglass.

Referring again to FIG. 2, it is noted that the overall area of the casting space is sufficiently large so as to completely encompass the damaged area.

In that portion of the side wall of the casting space which is below the mid-point 22 and designated herein as 24, slots or notches 26 are cut. These slots are generally located about midway between the mid-point 22 and the bottom surface 14 of the mold. There should be at least two slots and they are disposed about the periphery of the side 24 of casting space 20. Thus, in a conventional case, four slots or notches 26 would be set at 90° angles from one another and are appropriately about twice as long as they are deep. Typically, for example, they might be 4 inches long by 2 inches deep or 3 inches long by 1½ inches deep. The notches would generally be about 1 inch wide, although, of course, this will vary depending on the exact size of the mold bottom. The notches may be cut by any of the conventionally known methods, such as, oxy-arc, oxy-carbon, an oxygen burning bar or AC4 iron powder torch.

In a typical big-end-up closed bottom mold, the thickness of the bottom of the mold would generally be about 9 inches. The typical diameter of cross-sectional area $x$ may be anywhere from 9 inches to 16 inches as may be the diameter of cross-sectional area $y$. It is possible, of course, for the diameters of cross-sectional area $x$ and $y$ to be different or, they can be equivalent to one another.

Inasmuch as it is the function of the shape of the casting space 20 to be such so as to form an insert in the bottom of the mold which is essentially self-locking, it is important that the differential between cross-sectional area $z$ and cross-sectional areas $x$ and $y$ be sufficiently great so as to produce such a locking effect. Preferably, the cross-sectional area of the interior portion, i.e., cross-sectional area $z$ is about two-thirds that of cross-sectional areas $x$ and $y$.

Slots 26 serve to further ensure locking of the insert which will ultimately be formed in casting space 20 and merely provide further securement of the insert into the bottom of the mold.

After the casting space has been formed, the entire bottom, both the outside and the inside, of the ingot mold near or within the casting space should be cleaned so as to be free of all debris and oxidation or rust. Thus, in order to obtain the best bond for the insert to be welded into the casting space, clean smooth surfaces are important. This cleaning may be effected using the conventional type of air chipping hammer, or chisel, air grinder or silicon carbide discs, wire wheels, etc. Also, any minor depressions or gouges on the inside of the mold should be smoothed out. After the removal of such debris and smoothing, the surfaces of the area to be recast are blown clean using an air line.

A mold stool which is sufficiently large so as to provide at least a one foot or more area in excess around the periphery of the mold bottom is then prepared by first leveling, cleaning and securing the stool so that it will not rock. Thereafter, a refractory type of material, such as, for example, refractory clay or ramming compound is spread over the area on which the mold will be placed and is smoothed out. The perimeter of the layer of refractory material should be coextensive with the sides of the mold to be placed thereon. The mold is then placed in an upright position on the layer of refractory material.

Figure 4:
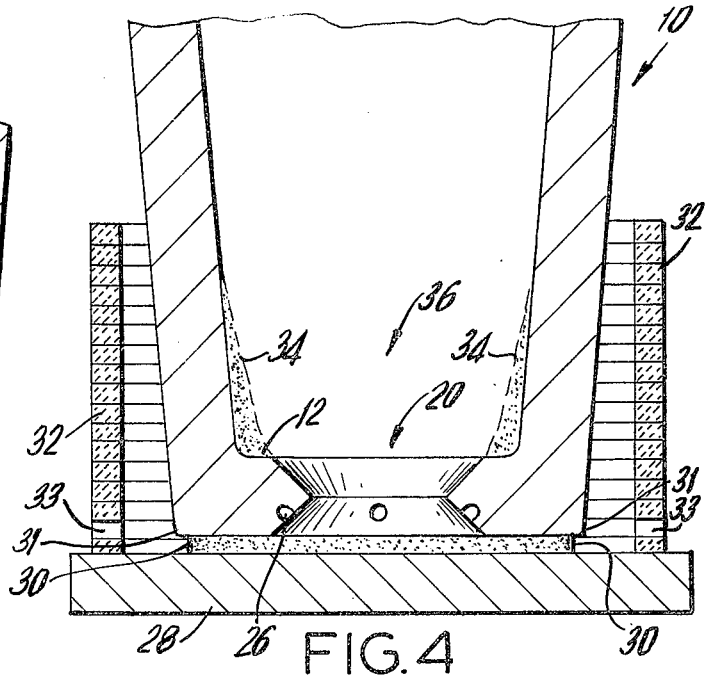
FIGS. 3, 4, 5, and 6 are sequential illustrations of ingot molds at various stages of the process in accordance with the present invention.

Referring now to FIG. 4, a cross-sectional partial view of a mold having casting space 20 cut therein is shown sitting on the top of stool 28 which has a layer of refractory sand 30 thereon. Inasmuch as the surface of this refractory material will provide the bottom retaining surface for the welded insert, it is important that it be relatively smooth and compact and sufficiently thick such that molten metal from the weld does not penetrate therethrough onto the stool surface. For this reason, the refractory sand 30 is packed tightly under the outermost corners 31 of the bottom of the mold to expose several inches of the corner of the mold. For this purpose, it may be necessary to add additional sand. The exposed corner 31 also provides an area for heating the mold as is explained hereinafter.

Additionally, from the interior of the mold, the refractory material is packed through casting space 20.

A wall of refractory brick 32 is constructed around the exterior of mold 10 several inches from the side of the mold to a height which is several inches above the inner surface of the inner surface of the bottom 12 of the mold. This wall also has several openings 33 spaced equidistantly around the mold which provide access for heating the bottom of the mold.

On the interior portion of the mold, a protective coating of the refractory material is provided and formed in such a way as to provide a funnel type chamber designated generally as 36 with downwardly and inwardly sloping sides towards the casting space 20. The height of this protective coating 34 should be sufficient such that when the alumino-thermic material is introduced to the interior of the mold, the protective coating extends above the level of the alumino-thermic material.

The function of the layer of refractory material 34 on the interior of the mold is to make certain that molten metal from the reaction of the alumino-thermic material does not attack the side portions of the mold. Furthermore, it provides, by virtue of the sloping sides of the chamber which it creates, a smooth gravitational flow of molten metal into casting space 20.

Typically, the protective layer will generally have a height of about 14 inches to 16 inches above the interior surface 12 of the bottom of the mold. Understandably, depending on the geometry of the inside of the mold and the size of the cross-sectional diameter of cross-section *x* (see FIG. 3) the exact slope of the packed refractory material will vary. It is important, however, that the slope be such as to assure a satisfactory rate and uniformity of gravitational flow of the molten metal formed from the reaction of the alumino-thermic material into the casting space. Obviously, the steeper the sides of the chamber 36, the faster will be the rate of this flow.

After completion of the packing of the protective layer 34, the interior sides of the casting space 20 should be cleaned of any excess sand.

Thereafter, all of the moisture is removed from the packed refractory material by heating. However, the refractory material itself is not directly heated since this can cause cracks to form therein. Rather, heat is generally applied to the lower outside walls of the mold by gas burners directed through holes 33 left for this purpose when the brick wall is constructed so as to gradually heat up the entire bottom of mold 10 including the protecting layer of sand 34 therein as well as sand 30 about the bottom thereof. On an average size mold, such heating using two to four burners requires about 2 to 3 hours. However, sufficient heating time must be used to relieve the refractory material and mold of any moisture.

Figure 5:
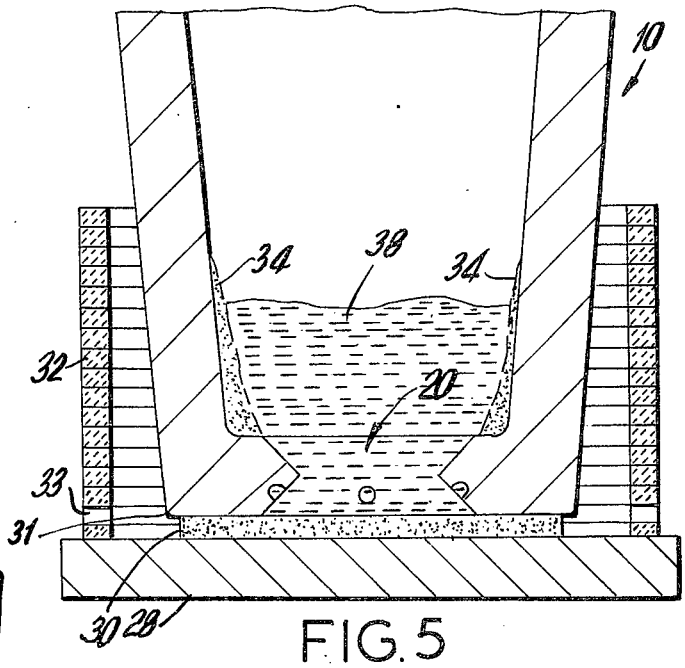

Thereafter, a predetermined amount of alumino-thermic material is introduced into casting space 20. Referring now to FIG. 5, alumino-thermic material 38 has been introduced into casting space 20. The amount of alumino-thermic material used is based on that amount required to produce sufficient weld metal to completely fill casting space 20. As shown, however, it is clear that a substantial portion of the alumino-thermic material 38 will be above the actual casting space 20 and rest against the protecting layer 34. It is thus important that the protecting layer 34 be of sufficient height so as to be above the top level of alumino-thermic material 38.

The calculation as to the amount of alumino-thermic material required will depend, of course, on the actual volume of casting space 20 as well as the yield of the alumino-thermic material utilized. Conventional typs of alumino-thermic material may be utilized which provide both steel as well as iron weld metal. These are well-known and conventional in the art.

The top of alumino-thermic material 38 is slightly dished so as to receive the igniting material and also to provide better gravitational flow of the weld metal.

Thereafter, the entire assembly as shown in FIG. 5 is heated utilizing the same type of burners used for removing moisture from the refractory material. The heating is continued until the bottom portion, generally, the bottom 12 inches of the mold turn cherry red therein. This serves to completely heat the surfaces of the casting space as well as the alumino-thermic material. Generally, such heating will take from about 4 to 10 hours on the standard mold.

The alumino-thermic material is then ignited in the conventional manner by placing the lighted ignition material into the dished portion of the top of the alumino-thermic material 38, and the reaction ensues. The entire reaction of the alumino-thermic material generally takes between about 2 to 4 minutes.

Thereafter, the entire assembly is allowed to cool down which will generally require an overnight or 24 hour cooling period.

Figure 6:
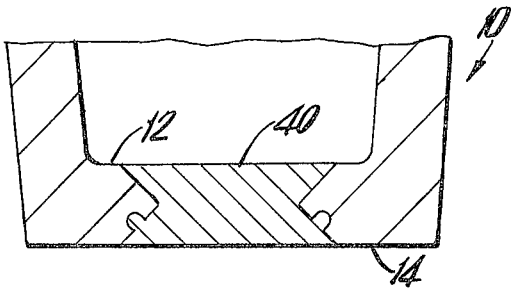

The assembly may then be dismantled and the slag formed from the alumino-thermic reaction is cleaned off utilizing a jack hammer fitted with a piercing chisel. After cleaning, a completed insert 40 as shown in FIG. 6 is obtained which is securely locked and fitted into the bottom of mold 10 providing a repaired mold bottom which, in practice, performs in a manner equivalent to that of a brand new mold bottom.

Considering now the repair of a big-end-up plug bottom mold, the procedures utilized are generally the same as those used for a closed bottom mold. However, it is clear that provision must be made in the casting space for forming the opening for the plug. That is to say, the bottom of the mold cannot be completely closed.

Figure 7:
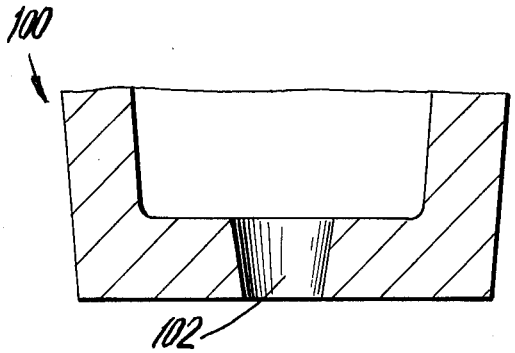
FIG. 7 is a view similar to that of FIG. 1 of a plug bottom ingot mold.
Figure 8:
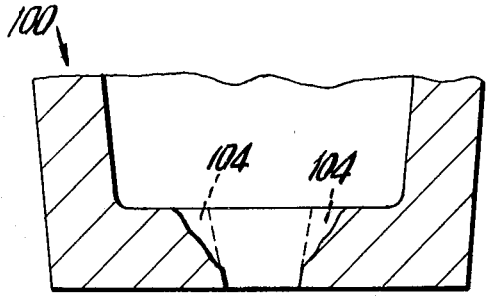
FIG. 8 is a view similar to that of FIG. 2 of a plug bottom ingot mold.

Referring to FIG. 7, a partial cross-sectional view of a plug bottom mold is shown having a hole 102 therein for the plug. FIG. 8 depicts such a mold wherein erosion has occurred. Dotted lines 104 indicate that portion which must be replaced utilizing the repair method of the present invention.

Figure 9:
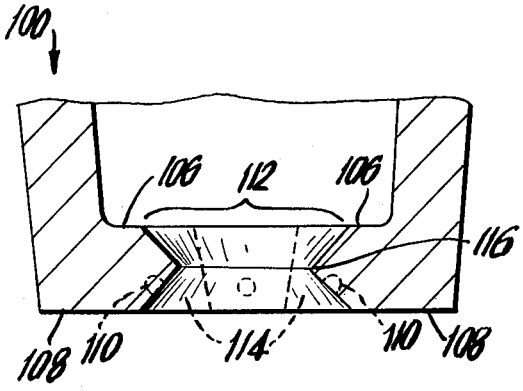

FIG. 9 is a view similar to that of FIG. 3 illustrating the shape of the casting space 112 which is to be formed for repair of a plug bottom mold. Dotted lines 114 indicate the shape of the insert which is to be formed by welding. It can be seen from FIG. 9 that the cross-sectional diameters of the casting space 112 at the inner surface 106 and outer surface 108 of the mold bottom possess the same relationship with respect to the cross-sectional area of the interior portion of the casting space as do the corresponding cross-sections shown in FIG. 3. Additionally, notches or slots 110 are formed in essentially the same manner and the same position as they would be for a closed bottom mold.

Thus, in essence, the same relationship between the cross-sectional areas exist and up to the point of cutting the casting space, the identical procedures are utilized for a plug bottom mold.

Figure 10:
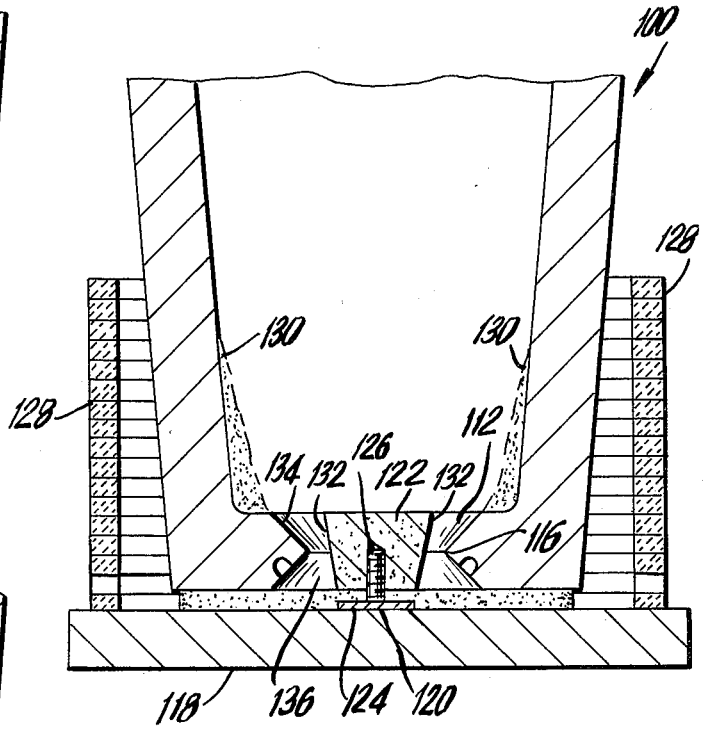
FIGS. 9, 10, and 11 are sequential illustrations of plug bottom ingot molds at various stages of the process of the present invention.

Referring now to FIG. 10, the major departure from the process utilized for the plug bottom as opposed to a closed bottom mold is depicted. Thus, after forming casting space 112, the mold is cleaned and placed upon a smooth layer of refractory material as is done with the closed bottom mold. However, before forming the layer of refractory material 116 on stool 118, a device 120 for securing a tapered graphite plug in the mid portion of cast space 112 is attached to stool 118. In practice, this device is composed of a metal plate 124 having an upstanding threaded rod 126 attached thereto.

Thus, the plate 124 with the threaded member 126 attached thereto is first secured to the stool 118 and then the layer of refractory material 116 is placed onto stool 118 in the manner described hereinabove. Thereafter, the ingot mold 100 is situated on the layer of refractory material and refractory brick walls 128 are formed as described hereinabove. Subsequently, the protective layer of refractory material can be formed on the interior portion of molds 100.

After this has been done and prior to heating the assembly to remove the moisture from the refractory material, a tapered plug 122 having a threaded hole in the bottom adapted for screwing onto and securement to threaded rod 126 is inserted into the middle portion of casting space 112. The plug is preferably made of graphite although another noncombustible material could be used.

In any event, the plug possesses tapered sides 132 the taper of which corresponds to the taper of the plug in the ingot mold blue print dimensions.

Thus, upon securement of plug 122 onto rod 126, a new annular casting space designated as 136 is formed which is bound on one side by the sides of casting space 112 and on the other side by the sides of plug 122.

In practice, plug 122 has means (not shown) in the top thereof for placement of the plug onto rod 126. Typically, this can take the form of a long rod attached to the top of the plug so that it is unnecessary to climb into the interior of the mold to place the plug therein. Thus, inasmuch as protective layer 130 has already been formed, it is best to avoid disturbing the interior of the mold.

Having thus secured plug 122, the entire assembly is heated to remove the moisture in the manner described hereinabove with respect to the closed bottom mold. Subsequent to the moisture removal, the amount of alumino-thermic material calculated to form the insert which will take the shape of casting space 136 is introduced to the interior of the mold, the top being slightly dished in the manner also described hereinabove.

The entire assembly is then heated until the bottom of the mold assumes a cherry red color and the ignition and reaction of the alumino-thermic material is affected.

After cooling of the assembly, and removal of the molds from the stool, plug 122 (after removal of rod 126), is simply punched out of the mold using the same type of technique conventionally used for removing plugs from plug bottom molds when an ingot has been poured. Of course, if a graphite plug is used, it is possible after cleaning of the mold, to simply pour an ingot and remove the graphite plug upon removal of the ingot from the mold.

Figure 11:
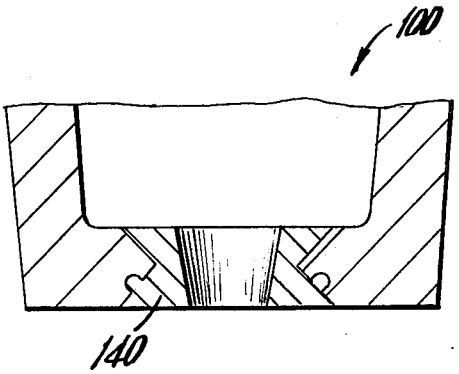

The final form of the repaired plug bottom mold is shown in FIG. 11 wherein insert 140 is depicted.

The following example illustrates the present invention:

A big-end-up closed bottom mold having substantial erosion in the center portion of the bottom and having an interior size of 25 inches × 32 inches was used. The bottom of the mold was 9 inches thick.

The bottom of the mold was cut out so as to form an hourglass shaped casting space through the bottom of the mold. The shape of the casting space was circular and the diameter at the inner surface of the mold bottom was 16 inches and the diameter at the bottom surface of the mold bottom was 12 inches. The sides of the casting space from the top and bottom surfaces of the mold bottom tapered inwardly to a diameter of 11 inches at the mid-point.

The entire area about the casting space was then cleaned of any rust and oxide. The area of the casting space was calculated by considering that the entire casting space was a cylinder having a diameter of 13 inches which is the average of the two maximum and the minimum diameters of the casting space. The volume of such a cylinder is 1,194 cu. inches. This value is then multiplied by 0.28 which is the density of the cast iron which had to be replaced thus giving the weight of the cast iron to be replaced.

Using a cast iron alumino-thermic mixture giving a 40% yield, the weight of such material required was then 2.5 times the weight of the cast iron needed. Thus, 334 lbs. of cast iron had to be replaced and this required 835 lbs. of alumino-thermic material.

Foundry sand was spread on a stool to a depth of 3 inches and smoothed out. the mold was set on the sand in an upright position and foundry sand was also packed inside the mold. A wall of refractory brick was placed around the outside of the mold.

Two 4 inches gas manifolds were arranged about the periphery of the fire brick each one having four 2 inches nozzles which were directed through holes left in the fire brick onto the mold to dry the sand and the mold for 1½ hours.

Thereafter, 835 lbs. of alumino-thermic mixture were placed in the mold and the mold was heated for 2 more hours. The alumino-thermic mixture was ignited and the reaction was complete within about 4 minutes.

After cooling for 24 hours, an 80 lb. air hammer was used to break up slag formed on the inside of the mold and a solid insert had been formed in the casting space.

While specific embodiments of the invention have been shown and described in detail to illustrate the application of the inventive principles, it will be understood that the invention may be embodied otherwise without departing from such principles.

Having thus described our invention, what it is intended to claim is:

1. A method for repairing an eroded bottom of an ingot mold which comprises:

a. removing the eroded portion of the bottom;

b. forming a casting space in the mold bottom by cutting a hole through the bottom of the mold, the cross-sectional area of the hole varying such that the diameter of the hole at the inner and outer surfaces of the bottom of the mold are larger than the cross-sectional area of the hole at the interior portion of the mold bottom, the sides of the hole tapering outwardly from the interior portion of the mold bottom towards the inner and outer surfaces of the mold bottom;

c. cutting one or more notches in a portion of the outwardly tapering side of said hole which is between the point of the hole having the smallest cross-sectional area and the outer surface of the mold bottom;

d. placing the mold in an upright position on a smooth layer of a compactable refractory material;

e. providing a protective layer of a refractory material about the inner walls of the mold; said layer beginning at the interior entrance of said hole and tapering upwardly and outwardly along the inner walls of the mold;

f. filling said casting space and a portion of the bottom interior volume of the mold with an alumino-thermic welding material in an amount effective to provide sufficient weld metal to fill said casting space;

g. igniting said alumino-thermic mixture; whereby molten metal is formed from the aluminum thermic reaction and gravitates downwardly into and filling the casting space to form, on cooling, an insert firmly welded and locked into the casting space.

2. The method of claim 1, wherein the refractory material is selected from the group consisting of ramming compounds and foundry sands.

3. The method of claim 1, wherein the casting space possesses a circular or elliptical cross-section.

4. The method of claim 1, wherein the notches are rectangular in shape and have a length of about twice their depth.

5. The method of claim 4, wherein four notches are cut and are radially disposed about the sides of the casting space at 90° from one another.

6. The method of claim 1, wherein the minimum cross-sectional area of the casting space at the interior portion of the mold bottom is about two-thirds that of the largest cross sectional areas of the top and bottom of the casting space.

7. The method of claim 1, wherein the ingot mold to be repaired is a plug bottom mold and wherein after the mold has been placed in an upright position, a tapered refractory plug is secured in the casting space to create a new annular casting space bordered on the outside by the sides of the casting space and on the inside by the sides of the plug, the taper and size of the plug corresponding to that of the plug hole in the original mold.

8. The method of claim 7 wherein the plug is a graphite plug.

9. A closed bottom mold repaired by the method of claim 1.

10. A plug bottom mold repaired by the method of claim 7.

* * * * *